United States Patent [19]

Ebelt

[11] 4,109,418

[45] Aug. 29, 1978

[54] AUTOMATIC HONING MACHINE AND METHOD

[75] Inventor: Günter Ebelt, Westerholt, Fed. Rep. of Germany

[73] Assignee: Maschinenfabrik Gluckauf Beukenberg G.m.b.H., Gelsenkirchen, Fed. Rep. of Germany

[21] Appl. No.: 765,946

[22] Filed: Feb. 7, 1977

[30] Foreign Application Priority Data

Feb. 7, 1976 [DE] Fed. Rep. of Germany ..... 2604857

[51] Int. Cl.[2] ..... B24B 33/02; B24B 1/00

[52] U.S. Cl. ..... 51/34 F; 51/165.93; 51/290

[58] Field of Search ..... 51/34 F, 34 H, 34 J, 51/34 K, 165.93, 290, 349; 408/235

[56] References Cited

U.S. PATENT DOCUMENTS

| | | | |
|---|---|---|---|
| 2,247,502 | 7/1941 | Johnson | 51/34 F |
| 2,260,157 | 10/1941 | Zwick | 408/235 X |
| 2,315,794 | 4/1943 | Johnson | 51/34 F |
| 2,771,820 | 11/1956 | Meyers | 51/34 F |
| 2,797,531 | 7/1957 | Seborg | 51/34 F |
| 2,983,199 | 5/1961 | Daugherty | 408/235 X |
| 3,369,327 | 2/1968 | Estabrook | 51/34 J |

*Primary Examiner*—Gary L. Smith
*Attorney, Agent, or Firm*—Michael J. Striker

[57] ABSTRACT

A plurality of honing stones carried at the lower end of a honing spindle are rotated about the spindle axis and vertically stroked in a cylindrical recess to be honed. The upper end of the spindle is connected to a cross-member vertically displaceable on a machine frame and connected to one run of an endless chain whose other run is connected to a counterweight and which is spanned over a sprocket carried by a hydrostatic motor. A variable-displacement reversible pump connected to the motor changes the stroke direction in accordance with position signals produced by a position sensor in the machine. The force with which the tools bear on the workpiece is increased and decreased jointly with the tension in the chain.

15 Claims, 4 Drawing Figures

AUTOMATIC HONING MACHINE AND METHOD

CROSS-REFERENCE TO RELATED APPLICATIONS

This application is related to my commonly filed and assigned patent applications Ser. Nos. 965,944 and 965,945 the entire disclosures of which are herewith incorporated by reference.

BACKGROUND OF THE INVENTION

This invention relates to a method of and apparatus for honing a recess of circular cross-section in a workpiece. The apparatus has a honing tool which is reciprocable on a vertical guide of the machine frame and which is simultaneously rotatable, the tool being releasably attached to one end of a hollow honing rod secured to a cross-member and having grinding members which are displaceable radially of the longitudinal axis of the recess in the workpiece via adjusting means extending longitudinally through the honing rod.

In one prior art construction of a honing apparatus of the kind specified the cross-member is vertically reciprocated by thrust piston units, two vertical supports of the machine frame acting as at least an indirect guide for the cross-member. The rotary movement of the honing rod is derived from worms extending vertically and laterally through the cross-member and driven by chain drives disposed in the cross-member. The worms are rotated by electric motors, through chain drives. The grinding members of the grinding tool are displaced radially of the longitudinal axis of the recess in the workpiece to be machined by adjusting means extending through the hollow honing rod. The central adjusting means is operable by a hydraulic thrust piston unit which rotates with the honing rod. However, this arrangement necessitates hydraulic connections which give rise to leaks. The hydraulic thrust piston unit can also be directly attached to the cross-member, in which case the piston rod is carried on an axial bearing. However, both of these known embodiments prevent the drive motor from being connected directly to the honing rod, i.e., without an intermediate transmission in the form of chain drives.

In addition to these disadvantages, the prior art construction has another considerable defect, namely that the vertical reciprocation of the honing tool is fairly noisy and very uneven. The reason for this is not only the relatively considerable expense of open and closed loop control devices for reversing the cross-member from the upward to the downward movement and vice versa and the resulting sources of vibration, but also the inertia of the reversing elements. The result is that considerable shocks occur on reversal of the cross-member which, as well as heavily stressing the static and dynamic structural elements and making an unpleasant noise, also have detrimental effects on the quality of the workpiece surface being machined. Furthermore, the force exerted to move the cross-member must take into account the weight of the cross-member plus the weight of the honing rod and honing tool in addition to the force which is required for the abrasion of the workpiece surface. In the case of downward movement, for instance this means that the cross-member must as a rule be braked, while during the upward movement the force exerted must ensure the required abrasion of the workpiece surface and the lifting of the cross-member, the honing rod and the honing tool.

Another disadvantage of the known apparatus is the insufficient resiliance of the electric drive motors and the transmission devices connected thereto, which in spite of safety devices frequently cause the honing rod to break or result in the destruction of the honing tool, more particularly if a honing tool suddenly gets jammed due to the masses which even when stopped continue to rotate to a limited extent. The honing tool is very liable to get jammed more particularly in blind recesses such as blind bores.

SUMMARY OF THE INVENTION

It is an object of the present invention to provide a honing apparatus and method of the kind specified which requires less maintenance, with a longer life for the static and dynamic structural members and an extended useful life of the tools, while ensuring a substantially improved surface quality of the workpiece to be machined in a shorter time.

Accordingly, the present invention provides an apparatus for honing a recess of circular cross-section or cylindrical shape in a workpiece, the apparatus having a honing tool which is reciprocal on a vertical guide of a machine frame and which is simultaneously rotatable. The tool is releasably attached to one end of a hollow honing rod secured to a cross-member and having grinding members which are displaceable radially of the longitudinal axis of the recess in the workpiece via adjusting means extending longitudinally through the honing rod. In the apparatus the cross-member carries a hydrostatic motor producing the rotary movement of the honing rod as a component of a controllable hydrostatic transmission, the cross-member being attached to one of the two vertical runs of an endless pulling means which rotates in the machine frame in a vertical plane perpendicular to the longitudinal axis of the cross-member and is driven by a hydrostatic motor and which is monitored in a controlled manner as regards its position in relation to the machine frame. A counter-weight also guided on the machine frame is attached to the other vertical run.

One important feature of the invention is the mounting of the cross-member on a hydrostatically driven endless pulling means, with the simultaneous association of a counterweight. The main effect of the counterweight is that the same power is required during the upward movement of the honing tool as during its downward movement. No longer is it necessary to produce a decelerating effect, for instance during the downward movement of the cross-member, to bring the weight of the cross-member plus the honing rod and the honing tool into the correct relation to the force which is required for the necessary surface grinding of the workpiece. Another feature is that, during the upward movement of the cross-member, no extra force is required in addition to the grinding force to lift the total weight of the cross-member, honing rod and honing tool. Furthermore, the open and closed loop control systems previously required for this purpose, whether of an electric, pneumatic or hydraulic nature, are eliminated and costs are substantially reduced. Another important advantage is afforded by the closed pulling means guide. The movement of the honing tool is much quieter and more even as compared to the prior art construction. These effects improve the surface quality of the finished workpiece. The static and dynamic structural elements of the apparatus are significantly less heavily stressed and their life therefore lengthened. The honing tool also has a longer useful life. Another advantage is that use of a hydrostatic drive for upward and downward movement and for rotary movement of the honing tool means that there is no longer any risk of damage, more particularly to the honing rod. If the honing tool gets jammed in the workpiece the hydrostatic motors automatically adapt themselves to the drop in load until they stop. Breakages and destruction no longer take place.

The counterweight is preferably slightly heavier than the cross-member plus the honing rod and the honing tool. This gives the advantage that, if for instance the hydrostatic transmission fails because of leakages in the hydraulic system or when the apparatus is out of use over the weekend, the cross-member is automatically shifted into the top end position so that the honing tool is out of the workpiece. There is therefore no need for a special mechanism to lock the cross-member in its top end position, although such a mechanism can be provided for extra safety.

Advantageously, guides for the cross-member and counterweight are formed by columns, preferably of circular cross-section, which extend vertically through lateral supports of the machine frame having a U-shaped horizontal cross-section, the cross-member and the counterweight being guided on the columns by rollers and sliding sleeves respectively.

The columns for guiding the cross-member of the counterweight are therefore protected inside the lateral supports of the machine frame. The columns are spaced apart one behind the other in each support. The two front columns guide the cross-member and the two rear ones the counterweight. So that the cross-member can move upwardly and downwardly very smoothly and free from jolts and the honing tool can thus be pulled and pushed smoothly and evenly in the workpiece. The cross-member has two spaced pairs of rollers running on each of the two associated columns. The rollers of each pair engage around the respective column from opposite sides over a substantial zone of the periphery. To this end they are of hyperboloidal or hourglass shape. At least one roller of each pair is forced resiliently against the corresponding column. The rolling friction substantially reduces the energy needed for the upward and downward movement of the honing tool. There is also less wear, so that maintenance is simplified. For the counterweight it is enough to guide it on its columns by means of sliding sleeves, for instance, of brass or bronze, since in comparison with the cross-member, the counterweight is not subjected to any lateral forces.

In an advantageous embodiment of the invention, the pulling means comprises two lateral sprocket chains which rotate inside the lateral supports of the machine frame and are guided in both top and bottom reversal zones over pairs of spaced sprocket wheels. The cross-member and counterweight are connected between the sprocket chains so that tilting, more particularly of the cross-member, is avoided and a smooth quiet vertical reciprocation of the honing tool is ensured. Th use of sprocket chains inside the lateral supports also has the advantage that the chains are protected. Sprocket chains guided substantially in a right angle can if necessary comprise a number of links parallel one beside the other. In that case the sprocket wheels disposed at the end points of the right angle are constructed correspondingly. The sprocket wheels can be mounted separately on the machine frame. Equally well, however, the sprocket wheels of one sprocket chain and the corresponding sprocket wheels of the other sprocket chain may be attached in pairs of common shafts extending longitudinally through the machine frame. The use of sprocket chains also provides slip-free upward and downward movement of the honing tool.

In the aforedescribed embodiment, one of the sprocket wheels of each sprocket chain may be adjustable substantially perpendicularly to the central longitudinal axis of the pulling means in dependence on the force to be exerted for the grinding of the workpiece surface on the honing tool. The adjusting device may be, for instance, a hydraulically operable thrust piston unit. In this way the tensioning of the pulling means can be directly adapted to the stressing of the honing tool. If greater force is to be exerted on the honing tool, a corresponding signal is delivered to the closed loop controlling devices associated with the thrust piston units, so that the sprocket wheels are forced more strongly against the sprocket chains and therefore their tensioning is increased. When the stressing of the honing tool again decreases, a corresponding signal is delivered to cause the thrust piston units to make the sprocket wheels press less heavily against the sprocket chains. Conveniently, jointly adjustable sprocket wheels are provided for both sprocket chains. In that case the thrust piston units are connected in parallel. The tensioning of the pulling means is consequently automatically adapted to the instantaneous stressing of the honing tool. For particular applications, however, it is conceivable that a purely mechanical adjustment of the sprocket wheels, for instance, by hand, may be enough to enable the correct tenion of the pulling means to be maintained.

To ensure even running of the sprocket chains, the two upper sprocket wheels which deflect substantially horizontally that run of the pulling means which is connected to the counterweight may be mounted on a common shaft driven by a slowly running radial-piston motor. The radial-piston motor acts directly on the drive shaft and is connected via preferably fixed lines to a controllable, for instance, axial-piston pump. The radial piston motor can be attached to the outside of one of the two lateral supports of the machine frame.

The hydrostatic motor actuating the pulling means may form a component of a controllable hydrostatic transmission which can be reversed in dependence on the adjustable length and position of the working stroke. In a preferred embodiment the hydrostatic transmission has an axial-piston pump controlled by an adjusting device which is operable in dependence on time and/or path. The advantage of using a controllable hydrostatic transmission for the drive of the pulling means is that the movement of the cross-member can be reversed very sensitively at the top and bottom ends of the stroke. Independently of the particular construction of the pivoting device, the output of the axial-piston pump can be continuously changed down to zero when approaching the ends of the stroke and again increased beyond the zero point in the other direction. The result is uniform deceleration to a halt and a uniform run up to maximum speed in the opposite direction. The time required for the reversal can be freely selected and this is more particularly an advantage when honing blind bores. With blind bores it is desirable to have as short a reversal path at the bottom end of the stroke as possible. Suitably constructed adjusting devices, which can be influenced in dependence on time and/or path, ensure that the controllable pump associated with the hydrostatic transmission is automatically operated in accordance with intantaneous conditions. The gentle reversal obviate harmful vibrations, so that not only is the quality of the workpiece surface to be machined substantially improved, but the stressing of the static and dynamic structural members is also reduced and their life lengthened. Noise is also significantly reduced, thus having a positive influence on the health of the operators.

The adjusting device may be connected to an electronic forward or reverse counter which can be programmed for stroke length and stroke position and which is fed with pulses by a rotation pulse transmitter associated with one of the sprocket wheel shafts. In this way, the position of the honing tool during its stroke movements is derived from the rotary movement of the sprocket wheel shafts and the transmission ratios of the pulling means. This is done by sensing, using the rotation pulse transmitter, from one of the sprocket wheels shafts disposed in the upper or lower zone of the machine frame, the path travelled by the cross-member during one or several rotations of the sprocket wheel shaft. During one rotation of the sprocket wheel shaft the pulse transmitter delivers a predetermined number of pulses, and the angle of rotation between two successive pulses covered by the sprocket wheel shaft corresponds to a predetermined portion of the vertical travel of the cross-member. The pulses are fed to the forward and reverse counter which is programmed for the two end of stroke positions of the honing tool and their positions in relation to the maximum possible stroke. When the pulses delivered by the pulse transmitter correspond to the programmed number, the counter recognizes that the end of a stroke has been reached and transmits a signal to the adjusting device of the controllable pump, which then reverses the pump within a predetermined time to rotate the radial-piston engine driving the pulling means in the other direction. Due to the reciprocating movement of the cross-member, the forward and reverse counter used is advantageous, since it enables the required path information to be exactly evaluated in both directions.

With the aforedescribed embodiments it is possible to adjust or preselect the maximum pump output, for instance, by selecting the position of a pivoting swash plate of an axial-piston pump, so as to vary the vertical speed of the honing tool after a predetermined number of strokes. In this way the honing tool can be driven at any desired speed in the workpiece to be machined. By the fact that, for instance, the speed is changed at every second stroke, the grinding members, having regard to the rotary movement of the honing tool, engage the workpiece surface at a different angle during each stroke. This type of machining not only produces a more uniform grinding of the workpiece surface, but also more rapid material removal, while treating the honing tool gently. Furthermore, the quality of the surface is improved as regards the peak-to-valley height. Experiments have also shown that the workpiece is prevented from being smoothed so much that no material is removed from it, due to insufficient natural abrasion on the grinding members of the honing tool, i.e., due to insufficient self-sharpening of the grinding members.

The hydrostatic motor rotating the honing rod may be formed by a slowly running radial-piston engine which is attached to the cross-member and is coupled via its drive shaft directly to the hollow drive spindle.

The mounting of a slowly running radial-piston engine directly on the cross-member with direct connection to the drive spindle of the honing rod has the advantage that no extra transmissions are needed. The radial-piston engine is connected via flexible lines to a stationary controllable pump which, for instance, can be hydrostatic axial piston pump. The cross-member is torsionally rigid and therefore forms a very suitable bearing for the drive spindle of the honing rod which can have universal joints in its two end sections, so that the longitudinal axis of the clamped workpiece can deviate to some extent from the longitudinal axis of the drive spindle for floating action.

The drive spindle may have two longitudinal slots which are diametrically opposite one another relative to the spindle longitudinal axis and through which extends a transverse yoke acting on the adjusting means of the honing tool, the yoke being connected to a flange sleeve which is slidably engaged on the drive spindle and is subjected, with the interposition of an axial bearing and a pressure plate and against the effect of a resilient return force, to the action of at least one thrust piston unit effective substantially parallel to the spindle longitudinal axis. The advantage of this arrangement is that the radial displacement of the grinding members is effected completely independently of the rotary movement of the drive spindle. A thrust piston unit operating in parallel with the spindle longitudinal axis, preferably two thrust piston units used diametrically opposite each other relative to the spindle longitudinal axis, is attached inside the cross-member and acts via its piston rod on a circular thrust plate borne against an axial bearing on the flange sleeve.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawings.

SPECIFIC DESCRIPTION OF A PREFERRED EMBODIMENT

Figure 1:
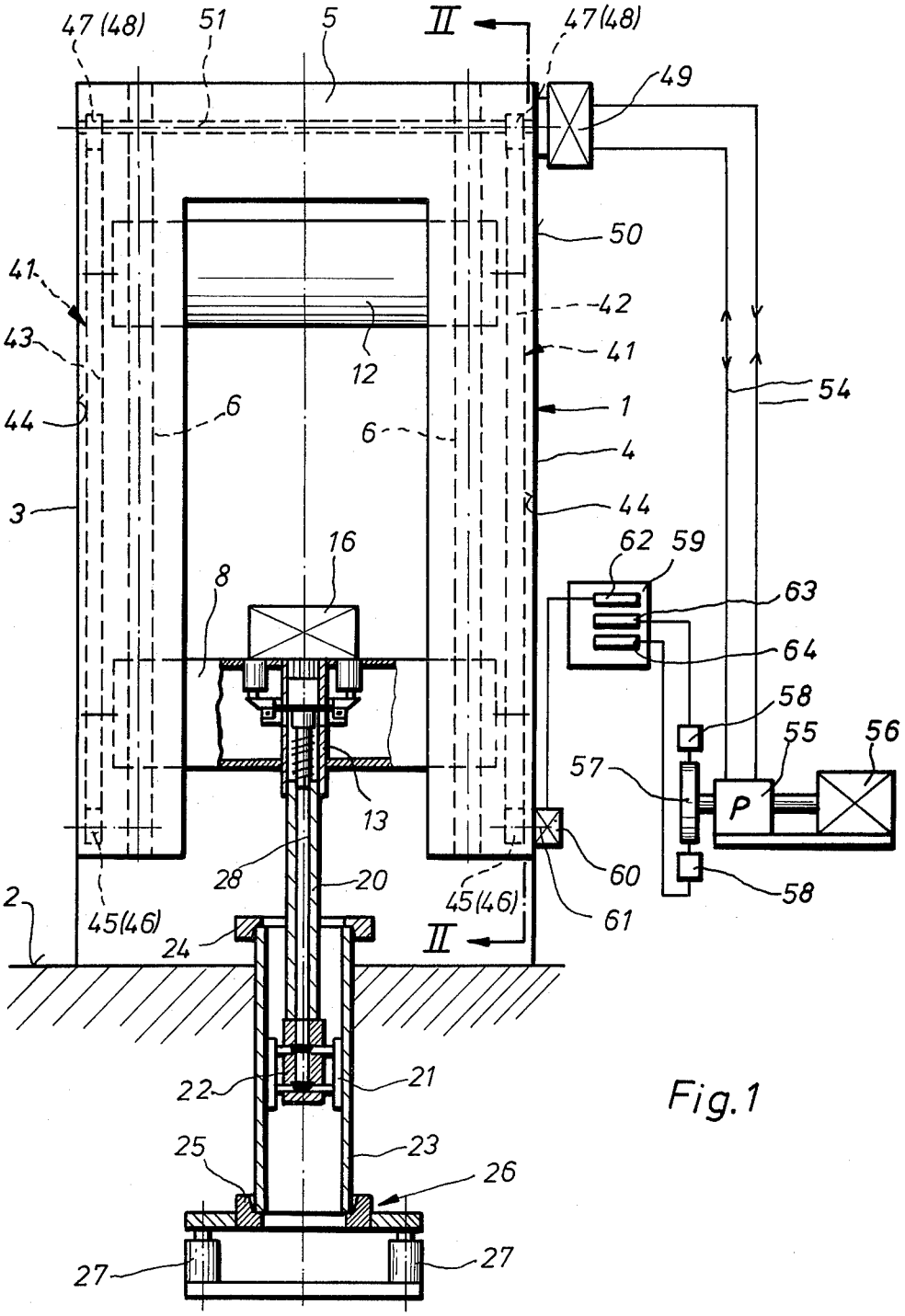
FIG. 1 is a partly diagrammatic and partly broken-away view of the apparatus according to this invention.
Figure 2:
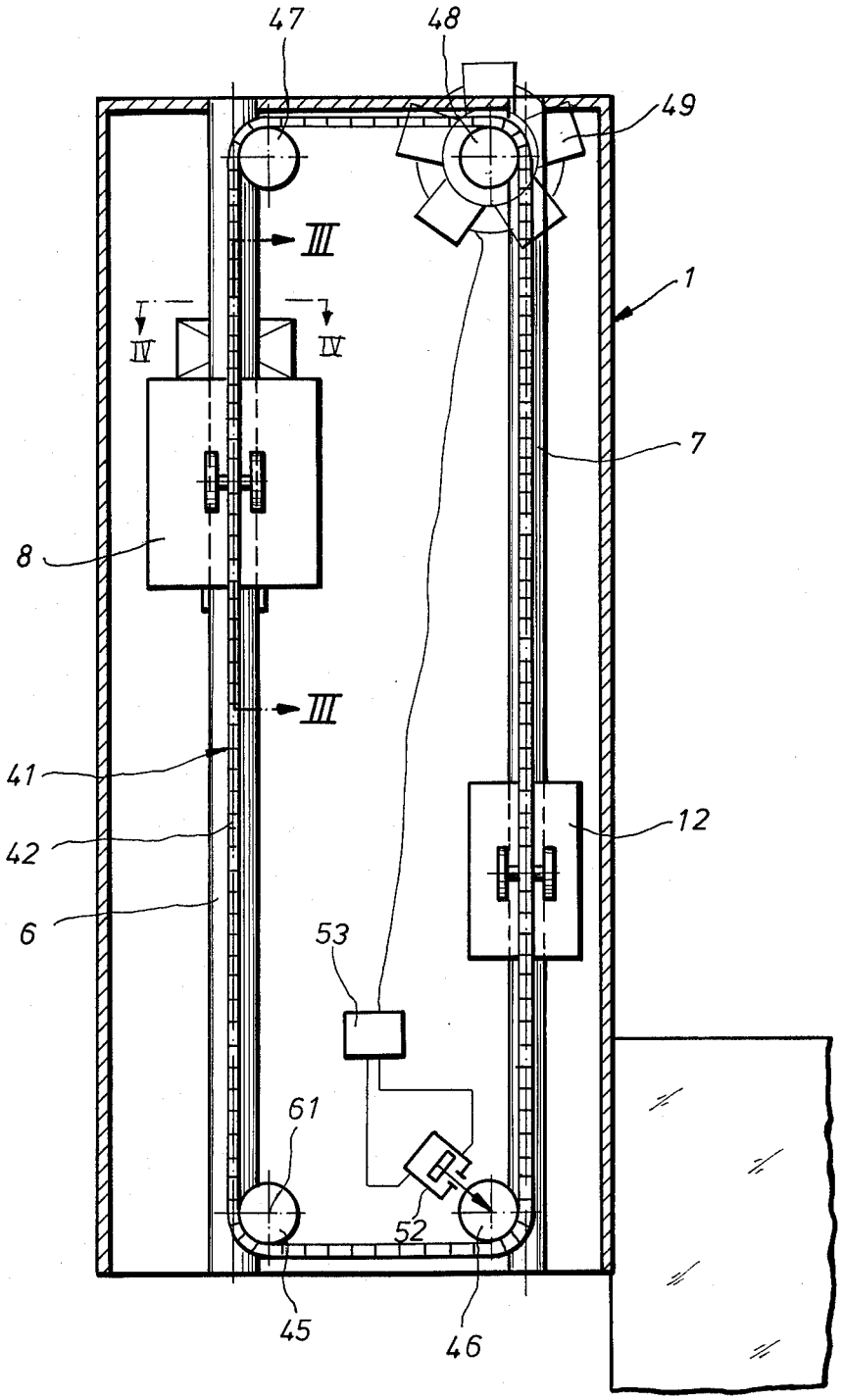
FIG. 2 is a section taken along line 11 — 11 of FIG. 1.

FIGS. 1 and 2 shows a portal-shaped machine support or frame 1 which stands on a floor 2 of a workshop and comprises two lateral supports 3 and 4 of substantially U-shaped horizontal cross-section, and a cross-piece or portal 5 of U-shaped vertical cross section interconnecting the tops of the supports 3 and 4. Two parallel columns 6 and 7 of circular cross-section and spaced horizontally one behind the other extend through the channel of each of the supports 3, 4 along the whole height thereof. The columns 6 and 7 are fixed to the machine frame 1. The two front columns 6 are of larger diameter and act as vertical guides for a box-like cross-member 8 which has its lateral end portions engaged in the channels of the supports 3, 4.

Figure 3:
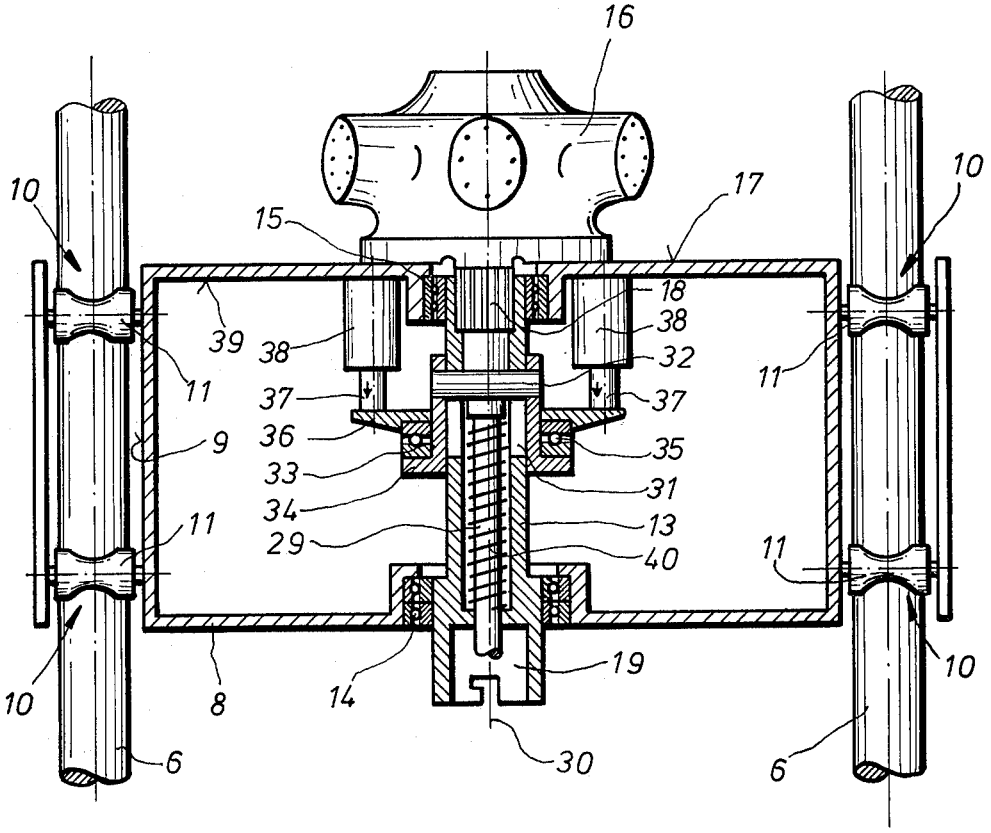
FIGS. 3 and 4 are sections taken along lines III — III and IV — IV of FIG. 2, respectively.
Figure 4:
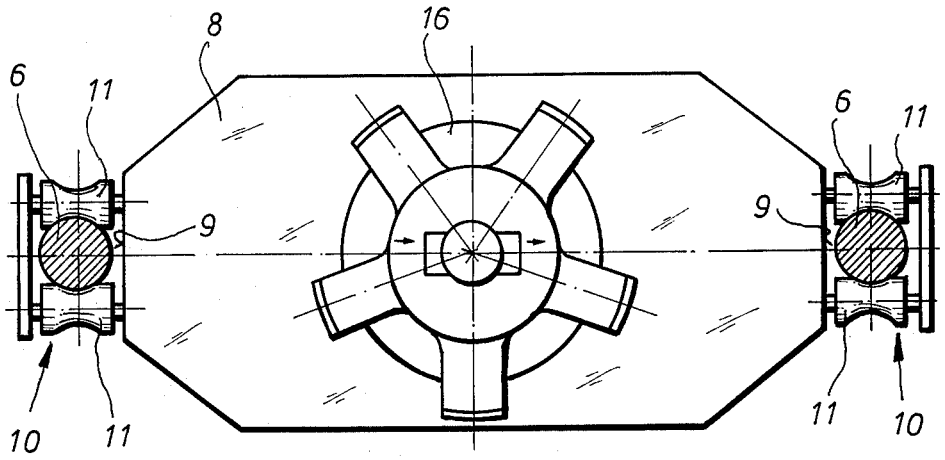

As shown in greater detail in FIGS. 3 and 4, roller guide assemblies are provided on the end faces 9 of the cross-member 8. The individual rollers forming these guides 10, 11 have a substantially hyperboloidal shape of a concavity matching the cross-section of the columns 6.

As shown by FIGS. 1 and 2, the two rear columns 7 act as vertical guides for a counterweight 12. Interchangeable sliding sleeves in the counterweight ensure smooth sliding movement thereof on the columns 7.

FIGS. 1 and 3 show a hollow drive spindle 13 extending through the center of the cross-member 8. The drive spindle 13 is pivotal in roller bearings 14 and 15 mounted on the cross-member 8. The rotary movement of the spindle 13 is produced by a slowly-rotating hydrostatic radial piston engine 16 which is attached to the upper side 17 of the cross-member 8 and engages via its output shaft 18 directly and positively in the top end of the drive spindle 13. The bottom end 19 of the drive spindle 13, which is outside the cross-member 8, is formed as a bayonet coupling for a hollow honing rod 20 shown in FIG. 1. Releasably attached to the free end of the honing rod 20 is a honing tool 22 which has radially displaceable grinding members 21. The honing tool 22 is disposed in a tubular workpiece 23 which is located in a clamping device 26 formed by rings 24 and 25. The clamping device 26 can be displaced vertically to a limited extent by means of preferably hydraulically operable thrust piston units 27.

The grinding members 21 are radially displaced by an actuating rod 28 which extends axially through the honing rod 20 and whose upper end portion 29 is shown in detail in FIG. 3. FIG. 3 also shows in detail how the actuating rod 28 can be axially displaced. The drive spindle 13 has, somewhat below where it is coupled to the radial piston engine 16 two slots 31 which are diametrically opposite one another in relation to the spindle longitudinal axis 30. The slots 31 are traversed by a rod-like transverse yoke 32 with sliding clearance. The two end portions of the transverse yoke 32 are secured in a flanged sleeve 33 slidably disposed on the drive spindle 13. The radially projecting flange 34 of the sleeve 33 carries an axial bearing 35 on which a circular thrust plate 36 is fitted. The thrust plate 36 is connected to the piston rods 37 of two hydraulically operable thrust piston units 38 which are arranged diametrically opposite one another in relation to the spindle longitudinal axis 30. The thrust units 38 are attached to the inside 39 of the cross-member 8. It can be seen that, when the thrust piston units 38 are extended, the transverse yoke 32 abuts the top end face of the end portion 29 of the actuating rod 28 and moves the actuating rod 28 downwardly against the resilient return force of a helical compression spring 40 disposed in the drive spindle, thereby radially outwardly displacing the grinding members 21 in the honing tool 22.

The upward and downward movement of the cross-member 8 and counterweight 12, which counterweight is slightly heavier than the cross-member 8 plus the honing rod 20 and honing tool 22, is effected by an endless floatable coupling 41 in the form of preferably parallel sprocket chains 42, 43 which are arranged in respective planes adjacent the facing surfaces 44 of the two lateral supports 3 and 4.

Each sprocket chain 42 and 43 is reeved over four coplanar sprocket wheels 45 - 48 which are arranged in pairs, in rectangular configuration, in the top and bottom end portions of the lateral supports 3 and 4. The sprocket wheels 45 - 48 are driven by a slowly running hydrostatic radial piston motor 49 attached to the outside face 50 of the support 4. (In FIG. 2 the position of the radial piston motor 49 is indicated in thin lines). The radial piston motor 49 directly drives a shaft 51 extending horizontally through the portal 5 of the machine frame 1 in the longitudinal direction thereof. The drive sprocket wheels 48 are mounted on the shaft.

FIG. 2 shows how the rear bottom sprocket wheels 46 are displaceably mounted on the uprights 3 and 4. To this end the sprocket wheels 46 are acted upon by preferably hydraulically operable thrust piston units 52 controlled from a common control system 53. A controller 59 is connected, for instance, to the radial piston engine 49. This arrangement is intended to balance the tensioning of the sprocket chains 42 and 43 against the pressing of the honing tool 22 against the workpiece 23. If therefore more power for machining is required from the radial piston motor 49, a signal is simultaneously fed to the control system 53, which actuates the thrust piston units 52 in order to press the sprocket wheels 43 more forcibly against the sprocket chains 42 and 43. When the power requirements on the radial piston motor 49 are again reduced, a corresponding signal is delivered to the control system 53 so that the thrust piston units are correspondingly retracted and therefore the tensioning of the sprocket chain is reduced.

The working medium is supplied to the radial piston motor 49 via fixed lines 54 from a hydrostatic axial-piston pump 55 with a pivoting swash plate. The pump 55 is driven by an electric motor 56. Associated with the pivoting swash plate is an adjusting device 57 with control heads or solenoids 58. The pivoted position of the swash plate can be preselected at the controller 59. Any particular pivoted position corresponds to a predetermined flow rate and therefore a predetermined speed of the radial piston motor 49, which in turn determines the vertical speed of the cross-member 8. The swash plate of the pump 55 can have different pivoted positions, in dependence on the stroke, so that these positions are also preselectable.

FIG. 1 also shows a rotation pulse transmitter 60 attached to a shaft 61 of the lower front sprocket wheel 45. During one rotation of the sprocket wheel shaft the pulse transmitter delivers a predetermined number of pulses so that, the angle of sprocket rotation between two successive pulses covered by the shaft 61 corresponds to a predetermined vertical travel of the cross-member 8. The pulses emitted by the pulse transmitter 60 are fed to an electronic forward and reverse counter 62 at the controller 59 which can be preprogrammed as regards the two end positions of the cross-member at the switches 63 and 64 for solenoid 58. A forward and reverse counter 67 is therefore used so that the required path information is correctly evaluated in both directions of movement to the cross-member 8. If the counter has received the number of pulses corresponding to one end position, it converts this information into a switching pulse which is communicated to the control heads 58 of the adjusting device 57 which then adjusts the pivoting bulb correspondingly in one direction or the other.

It will be understood that each of the elements described above, or two or more together, may also find a useful application in other types of grinding systems differing from the types described above.

While the invention has been illustrated and described as embodied in a honing system, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An apparatus for honing a circular-section recess in a workpiece with at least one abrasive honing tool, said apparatus comprising:
- a support;
- a vertical guide on said support;
- a cross-member vertically displaceable on said guide;
- a counterweight vertically displaceable on said guide;
- a flexible member interconnecting said counterweight and said cross-member;
- drive means including
  - a first hydrostatic motor on said support connected to said flexible member, and
  - a variable-displacement and reversible hydraulic pump connected to said first motor for oppositely vertically displacing said cross-member and said counterweight on said guide;
- sensor means on said support and connected to said pump for detecting the vertical position of said cross-member and for uniformly decelerating said cross-member and said counterweight to a halt and thereafter uniformly accelerating said cross-member and said counterweight in the opposite direction to reverse the vertical displacement of said cross-member each time each of a pair of vertically spaced end positions is reached;
- a tool spindle rotatable about an upright axis on said cross-member;
- a second hydrostatic motor on said cross-member connected to said spindle for rotating same about said axis;
- a holder on said spindle for said tool, whereby when said tool is in said recess said first hydrostatic motor can stroke it vertically therein while said second hydrostatic motor rotates it about said axis; and
- means on said cross member for pressing said tool radially of said axis against said workpiece at said recess.

2. The apparatus defined in claim 1 wherein said counterweight is heavier than said cross-member, said spindle, said holder, and said tool combined.

3. The apparatus defined in claim 1 wherein said guide is formed by a first pair of parallel vertical columns passing through said cross-member and by a second pair of parallel vertical columns passing through said counterweight.

4. The apparatus defined in claim 1 wherein said support is provided with at least one upper sprocket and one lower sprocket, said flexible member being a chain reeved over said sprockets and having one run connected to said cross-member and another run connected to said counterweight.

5. The apparatus defined in claim 4, further comprising means for biasing one of said wheels away from the other wheel with a force dependent on the force exerted by the tool on said workpiece.

6. The apparatus defined in claim 4 wherein said first hydrostatic motor is connected to said upper sprocket.

7. The apparatus defined in claim 1 wherein said second hydrostatic motor is mounted directly on said cross-member and is directly connected to said spindle.

8. The apparatus defined in claim 7 wherein said spindle is hollow and said means for pressing includes a rod passing longitudinally through said spindle and provided at its upper end with a laterally projecting part, and a hydraulic piston unit carried on said cross-member and having an axial-thrust bearing connected between itself and said part, said spindle being formed with at least one radially throughgoing hole accommodating said part.

9. The apparatus defined in claim 1 wherein said pump is an axial-piston pump.

10. A method of honing a cylindrical recess in a workpiece with a plurality of honing tools vertically reciprocal by means of and carried on an endless flexible member, said method comprising the steps of:
- longitudinally displacing said tools jointly through said recess with a predetermined variable displacement force in a succession of strokes of alternating longitudinal direction;
- rotating said tools jointly about a longitudinal axis of said recess while longitudinally displacing said tools;
- monitoring the position of said tools in said recess and reversing stroke direction each time said tools come to either of a pair of predetermined longitudinal positions in said recess;
- pressing said tools transversely against said recess with a predetermined variable abrading force;
- tensioning said flexible member with a predetermined tension force; and
- increasing said tension force when said displacement force increases and decreasing said tension force when said displacement force decreases.

11. The method defined in claim 10 wherein said tool is operatively connected to an endless flexible member serving for its vertical displacement, said longitudinal force being proportionally increased and decreased by increasing the tension in said member as said resistance increases and corresponding decreasing the tension in said member as said resistance decreases.

12. The method defined in claim 10 wherein said displacement and tension forces are maintained proportional to each other.

13. The method defined in claim 10, further comprising the steps of uniformly decelerating said tools to a halt at the end of each of said strokes and uniformly accelerating said tools from a halt at the start of each of said strokes.

14. The method defined in claim 13, further comprising the steps of counterbalancing said tools with a weight attached to said member and uniformly decelerating and accelerating said weight as said tools are decelerated and accelerated, respectively.

15. An apparatus for honing a circular-section recess in a workpiece with at least one abrasive honing tool, said apparatus comprising:
- a support;
- a pair of upright parallel and horizontally spaced columns fixed on said support;
- a cross-member extending between said columns and vertically displaceable along said columns;

at least one upper and at least one lower wheel vertically spaced on at least one of said columns;

an endless flexible and substantially inextensible member spanned over said wheels and having a pair of horizontally spaced and substantially parallel vertical reaches, one of said reaches being secured to said cross-member;

a counterweight secured to the other of said reaches, whereby said cross-member is counterbalanced by said counterweight;

drive means including a first hydrostatic motor on said support connected to said flexible member for oppositely vertically displacing said cross-member and said counterweight;

a tool spindle rotatable about an upright axis on said cross-member;

a second hydrostatic motor on said cross-member having an output shaft directly connected to said spindle for rotating same about said axis;

a holder on said spindle for said tool, whereby when said tool is in said recess said first hydrostatic motor strokes it vertically therein while said second hydrostatic motor rotates it about said axis; and means on said cross-member for pressing said tool radially of said axis against said workpiece at said recess.

* * * * *